US008069605B2

(12) United States Patent
Fressola et al.

(10) Patent No.: US 8,069,605 B2
(45) Date of Patent: Dec. 6, 2011

(54) GUN EQUIPPED WITH CAMERA

(76) Inventors: Alfred A. Fressola, Easton, CT (US); Andrew T. Hyman, Ansonia, CT (US); Brendan A. Fressola, Easton, CT (US)

( * ) Notice: Subject to any disclaimer, the term of this patent is extended or adjusted under 35 U.S.C. 154(b) by 951 days.

(21) Appl. No.: 12/074,091

(22) Filed: Feb. 29, 2008

(65) Prior Publication Data

US 2010/0284683 A1 Nov. 11, 2010

Related U.S. Application Data

(62) Division of application No. 11/189,222, filed on Jul. 25, 2005, now abandoned.

(60) Provisional application No. 60/590,701, filed on Jul. 23, 2004.

(51) Int. Cl.
*F41A 35/00* (2006.01)

(52) U.S. Cl. ..... 42/90; 42/1.08; 42/111; 396/426; 33/266

(58) Field of Classification Search ..... None
See application file for complete search history.

(56) References Cited

U.S. PATENT DOCUMENTS

| | | | | | |
|---|---|---|---|---|---|
| 3,733,727 | A * | 5/1973 | Jones et al. | 42/106 |
| 3,785,261 | A * | 1/1974 | Ganteaume | 396/426 |
| 3,911,451 | A * | 10/1975 | Vockenhuber | 396/426 |
| 4,290,219 | A * | 9/1981 | Boller et al. | 42/106 |
| 4,309,095 | A * | 1/1982 | Buckley | 396/420 |
| 4,630,911 | A * | 12/1986 | Paul | 396/426 |
| 4,907,022 | A * | 3/1990 | Myers | 396/426 |
| 4,989,024 | A * | 1/1991 | Myers | 396/426 |
| 5,164,753 | A * | 11/1992 | Fritzer | 396/322 |
| 5,301,448 | A * | 4/1994 | Petrick et al. | 42/70.01 |
| 5,396,069 | A * | 3/1995 | Craig et al. | 250/330 |
| 5,546,124 | A * | 8/1996 | Scerbo, III | 348/158 |
| 5,815,205 | A * | 9/1998 | Hashimoto et al. | 348/373 |
| 5,826,360 | A * | 10/1998 | Herold et al. | 42/1.02 |
| 6,000,163 | A * | 12/1999 | Gordon | 42/119 |
| 6,269,726 | B1 * | 8/2001 | McNulty, Sr. | 89/1.11 |
| 6,431,044 | B2 * | 8/2002 | Poole | 89/1.11 |
| 6,449,892 | B1 * | 9/2002 | Jenkins | 42/1.01 |
| 6,539,661 | B2 * | 4/2003 | Hope | 42/119 |
| 6,735,897 | B1 * | 5/2004 | Schmitter et al. | 42/70.01 |
| 6,823,621 | B2 * | 11/2004 | Gotfried | 42/70.06 |
| 6,925,742 | B1 * | 8/2005 | Van Zyl | 42/70.01 |
| 7,158,167 | B1 * | 1/2007 | Yerazunis et al. | 348/61 |
| 2004/0099134 | A1 * | 5/2004 | Gotfried | 89/1.11 |

* cited by examiner

*Primary Examiner* — Jamie Kucab
(74) *Attorney, Agent, or Firm* — Alfred A. Fressola; Ware, Fressola, Van Der Sluys & Adolphson LLP

(57) ABSTRACT

A stun gun is disclosed having a firing mechanism, and also having a camera for automatically capturing post-firing images after the firing mechanism is activated. The post-firing image is automatically and digitally marked, or partly marked, to indicate when the camera was used. A method of gun operation is also presented, along with a system that includes both the gun and a gun holder. Removal of the gun from the gun holder may activate the camera's visual or audio collection capabilities, and further actions such as removal of a gun safety may heighten activation of the camera. The camera's visual collection capabilities include viewing both the target and also the user of the gun.

10 Claims, 5 Drawing Sheets

GUN EQUIPPED WITH CAMERA

CROSS-REFERENCE TO RELATED APPLICATIONS

This application is a divisional of application Ser. No. 11/189,222 filed on Jul. 25, 2005.

The present invention claims priority to U.S. Provisional Application 60/590,701 filed Jul. 23, 2004.

BACKGROUND OF THE INVENTION

1. Field of the Invention

The present invention relates to guns, and in particular to security mechanisms to ensure proper use of guns. This invention is especially applicable to stun guns, for example stun guns that shoot one or more projectiles.

2. Description of Related Art

In this disclosure, the term "stun gun" is used broadly, and includes not only weapons that merely stun a target, but also weapons that induce electro-muscular disruption, either by firing one or more projectile at a target, or by simply prodding the target.

Typically, two projectiles are connected to a stun gun by respective wires. The user of the stun gun can send an electrical shock to a target via the wires, and may also have the capability to send successive shocks while the wires are still connected to the target. The general idea of a stun gun is well-known. See, for example, Smith (U.S. Pat. No. 6,636,412) which is incorporated herein by reference. Note that some stun guns can additionally be used to prod a target, without need to fire projectiles.

It is known in the art to store the time when a stun gun was fired. See, for example, TASER INTERNATIONAL, Advanced M-Series (www.taser.com/products/advanced01.html) which is incorporated herein by reference, as downloaded on Jul. 19, 2004. Smith's gun also includes a memory unit for recording when the gun has been fired. This data can help to protect lawful possessors of stun guns from claims of excessive force, by providing complete and accurate documentation of the time and date for each firing. This data can be downloaded by law enforcement supervisors, to a personal computer or the like, via a data port download (e.g. input/output port).

One well-known method of propelling the projectiles (e.g. probes) at a target utilizes compressed nitrogen, and these projectiles are connected to the weapon by high-voltage insulated wire. Every time a cartridge is fired, it is known to eject dozens of small confetti-like ID tags, each tag having the serial number of the cartridge fired, thus allowing police departments or other officials to determine which officer fired the cartridge. A drawback to these types of prior art inventions is that merely recording a date and time, and/or discharging informational confetti, will only provide a slight amount of information about the circumstances in which a stun gun is used.

Another major problem with existing stun guns is that they can be misused so as to inflict unnecessary pain, or to unnecessarily incapacitate a target. Although a normal gun (that shoots bullets) will seldom be abused—because its effects are very drastic—a stun gun can be used to inflict temporary pain without long term physical injury. As such, some prior art stun guns can be used as devices to facilitate abuse, or even torture, and therefore better technology is needed to monitor use of these weapons. The present invention helps to fill this need.

If a lawful possessor of a stun gun does not misuse the gun, there is still good reason for such lawful possessors to want to prove that they did not misuse the stun gun, in the event that they are suspected or accused of inappropriate use. Thus, a security system is needed that will provide evidence of how the stun gun was used, preferably producing such evidence in a straightforward and automatic manner. By providing such evidence, stun guns will more likely be appropriately used, especially in situations where lethal force is not required.

It is known in the art to combine a stun gun with a camera. See, for example, Gotfried (U.S. Pat. No. 6,823,621) which is incorporated by reference herein. Gotfried discloses that the camera is automatically activated when a gun is fired, or when a user places a finger on the trigger, or by remote activation. Gotfried's activation process can occur at predetermined intervals, and it can also include activation of a microphone. Gotfried does not disclose any way to capture a view of both the user and the target, whereas it is often important for evidentiary purposes to ascertain not just the behavior of the target but also the identity of the gun user. Additionally, Gotfried does not disclose any way to automatically activate a gun before a user places a finger on the trigger, during which time many significant events may be occurring in view of the gun.

Although Gotfried discloses wireless transmission of collected images, it is also known in the art to record collected images using a recording system within a stun gun. See, for example, the TASER INTERNATIONAL, *Video Digital Power Magazine or VDPM* (http://www.taser.com/press/releases/vdpm.html) which is incorporated herein by reference, as downloaded on Dec. 10, 2004. Nevertheless, the VDPM does not address or solve any of the problems identified above with respect to the other prior art.

BRIEF SUMMARY OF THE INVENTION

A central idea of the present invention is to combine a stun gun with a camera in a way that will operate more efficiently and effectively than the prior art. The present invention includes the idea of a stun gun memory that is statically or dynamically partitioned so that images associated with firing the gun are permanently stored at full resolution, and only deleted after downloading. The images and/or audio are automatically marked with date and time information corresponding to when they were captured. Additionally, the gun of the present invention includes a camera device capable of capturing images from more than one direction, including both the target of the gun as well as the user of the gun. Moreover, the present invention includes the idea of activating the visual image collection and/or audio collection automatically when the gun is unholstered or when its safety is released, even before the user places a finger on the trigger. The present invention furthermore includes the idea of discarding collected audio or video information if the gun is re-holstered without firing or re-holstered without placing a finger on the trigger. Further innovations will become apparent from the present specification and claims.

According to the method and apparatus of the present invention, the camera is affixed to or incorporated within the gun. The camera may be a still camera, or it may be a video camera, or a combination of the two. At least some of the images taken by the camera will be marked with the time and date at which the images were created. The term "images" is used throughout the present application to include a set of at least one still or video picture (which in some embodiments may also include an optional sound recording that may or may not be simultaneous with the visual images). The images will be tamper-resistant or at least will be tamper-evident so that tampering will be detectable; thus, a user of a stun gun will ordinarily be unable to alter the images and unable to alter the date and time information associated with the images. Instead, the images are typically downloaded by a special facility, for example a photo laboratory within a police department. The images are preferably digital in nature, including either still pictures or video, or both, and an audio track is also advantageous in some embodiments. The audio capability not only allows the gun user to record sounds in the environment, but also allows the gun user to provide a narrative real-time description of what he or she is doing.

When the present invention is used in conjunction with a stun gun, the camera can advantageously share a common power supply with the stun gun, and thus will not require separate batteries. The camera will preferably have a wide angle lens, and will preferably be positioned so as to record an image including at least the direction in which the gun points. A wide angle lens will be especially useful if the gun user experiences recoil, in which case the gun may be pointing in a different direction when the image is captured, as compared to its direction when the gun was fired.

The camera, or a second camera, can optionally be configured to capture an image of the user of the stun gun. For example, if a single camera is used, a small mirror can reflect an image of the user into the forward-pointing camera lens.

The camera will preferably be arranged so as to automatically take at least one post-firing image when the gun is fired. A slight time delay is potentially useful, so that the image will not be obscured by the flash from the muzzle that occurs when the gun is fired. The gun, of course can be equipped with a flash device, for use in the dark, so that the target will be illuminated.

Optionally, it may be desirable for the camera to also acquire at least one contextual image of the scene before the gun is fired. A useful way to accomplish this is for the camera to be automatically activated when it is taken out of its holster (or other similar holding device), and/or when a safety device is released preparatory to firing the gun, and/or when any pressure is initially placed on the stun gun trigger. It is also useful to record the time at which the gun was unholstered and/or the time at which the safety was released and/or the time at which any pressure is applied to the stun gun trigger. According to one embodiment, removal from the holster can activate one level of camera activity, and release of the safety can trigger an enhanced level of activity, and initial pressure on the gun trigger can enhance the camera activity even more, and firing the gun can then trigger the highest level of camera activity.

Once the camera is activated, it can capture images continuously, or at regular or irregular intervals. Keep in mind that the camera may include an audio recording device, and may capture still and/or video images, and also may include more than one lens pointing in more than one direction.

In order to minimize data storage requirements, each of those images can be deleted when another image is taken, and then, for example, only the pre-firing images most closely preceding the gun discharge would be saved in the data storage area. This sort of rolling-type data storage can be implemented in a variety of different ways, for example so that the end result will be a plurality of pre-firing images spaced progressively more closely in time. Also, instead of merely deleting or not deleting images in the manner just described, image quality can alternatively (or additionally) be reduced. Either deletion of images or reduction of image quality (or both) will have the effect of freeing up storage space. This rolling-type technique can be especially useful for types of images that have large storage requirements, such as when an image includes high-quality video with soundtrack. However, high-priority images will preferably be exempt from deletion or quality reduction, and those high-priority images would include, for example, an image immediately subsequent to a previous discharge (i.e. firing) of the gun.

Another option is to have one or more still picture before the discharge, and then to have a limited amount of video after the discharge. In any case, in the event of a second discharge of a conventional gun or a second shock by a stun gun, the contextual images preceding the first discharge can be partially deleted (and/or reduced in quality) in order to create data storage pace for the images associated with the second discharge.

The data storage is preferably implemented in the gun itself. It can also be fully or partly located in the holster with a link between the gun and the holster when the gun is holstered.

These and other objects, features and advantages of the present invention will become more apparent in light of the following detailed description of a best mode embodiment thereof, as illustrated in the accompanying drawings.

DETAILED DESCRIPTION OF THE INVENTION

Figure 1:
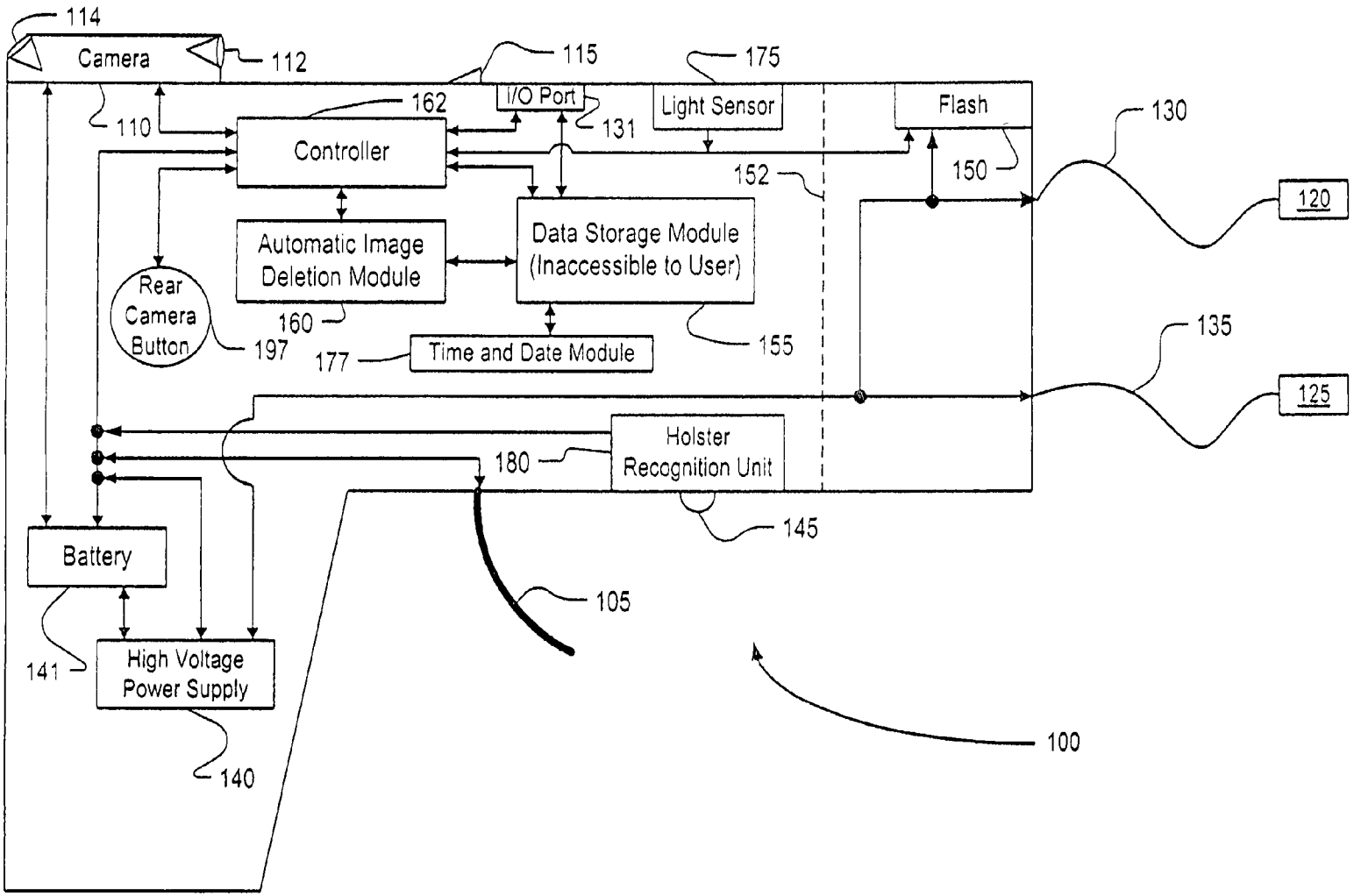
FIG. 1 shows a stun gun according to an embodiment of the present invention.

In order to more fully understand the present invention, an embodiment thereof is illustrated in accompanying FIG. 1. The relative positions of the various components shown in FIG. 1 are exemplary only, and considerable variation of those positions is acceptable. The gun 100 is a handheld stun gun that fires projectiles 120 and 125 (hereinafter "firing" the stun gun refers to beginning to deliver a shock either with or without shooting projectiles, unless otherwise indicated). These projectiles, such as darts, are connected to the gun by respective wires 130 and 135, which are linked to a high power voltage supply 140 that is powered by a battery 141. This same battery 141 can also power a camera 110. When the firing mechanism 105 is activated (by contact with a user's finger), the battery 141 supplies power to the camera 110 so that the camera will capture an image shortly after the projectiles 120 and 125 are fired. The camera is shown toward the rear of the gun in FIG. 100, but it can of course be located in any convenient location on the gun. The camera can be located at the front of the gun, especially if the gun is configured to only deliver a shock via the projectiles 120 and 125 with wires 130 and 135, instead of also being capable of delivering a shock by prodding the target.

Subsequent to firing the projectiles and delivering the shock to the target, the wires and darts are removed from the rest of the device, and a new cartridge is mechanically coupled to the stun gun housing. A cartridge may contain the high voltage power supply 140, in which case that power supply 140 would preferably be located nearer to the muzzle than is shown in FIG. 1. The time and date at which the old cartridge is removed and the new cartridge installed can optionally be recorded in the data storage module 155.

When the camera 110 captures an image, that image is sent to a data storage module 155. An image deletion module 160 can optionally make room for the image by deleting a portion of previously stored images (and/or reducing the quality of a portion thereof), except that certain high-priority previously stored images may be exempt from deletion and from quality reduction. Previously stored images that can be deleted or subjected to quality reduction may have been captured, for example, when a camera activation mechanism 145 sensed that the gun was no longer holstered, and/or when the safety was released, and thus the camera is able to capture images previous to the gun being fired. This camera activation mechanism 145 may, for example, include a simple hemisphere that is depressed when the gun is holstered, but is not depressed otherwise.

The data storage module 155 is inaccessible to the user, and can only be accessed by a police laboratory or the like via the input/output port 131, utilizing the necessary equipment and/or access codes. Likewise, the optional image deletion module 160 is automatic, and therefore the user cannot make the deletion module 160 delete specific images from the data storage module 155.

In addition to powering the camera, and in addition to powering the stun delivery system which may include the projectiles and wires thereto), the battery 141 can also power a flash unit 150 that allows the camera to operate in dark environments. The flash is preferably positioned so that it will illuminate the target and optionally illuminate the user of the stun gun, who is visible to the camera via a mirror 115 or via a rear-facing lens 114, or both (thus enabling confirmation of the user's identity). The forward-facing lens 112 is intended to take pictures of the target both before and after the gun is fired, according to this embodiment. The camera can also be equipped with a laser sight that is also activated by releasing the safety, or activated by taking some other preliminary action necessary for firing the gun. The laser sight will preferably be powered by the same battery 141 that powers the stun delivery system, the camera, a time and date module 177, and the flash unit 150 (or alternatively separate batteries can be used for these purposes). The line 152 indicates that the section to the right of that line may be a removable and replaceable cartridge, and in this particular embodiment the flash 150 is disposable, although a permanent flash can alternatively be used (in which case the flash would not be part of the cartridge).

The rear-facing lens 114 may optionally be useful for capturing images unrelated to firing the gun. In such a case, if the user does not have a separate camera available, then the user can point the lens 114 roughly in the direction of an object to be photographed, while pointing the muzzle of the gun downward, and capture the image by pressing a rear camera button 197 located, for example, on a side of the gun. This image is stored in the data storage module 155, but in a manner that does not allow deletion of previously stored images associated with use of the stun gun to deliver a shock. The button 197 can have an opposite button on the opposite side of the gun, so that both buttons have to be pressed in order for the user to take a picture; this would reduce the chance of the camera taking a picture when the button 197 is pressed accidentally (e.g. when the gun bumps up against something).

The stun gun can also be equipped with other useful features, such as a light sensor 175, so that the flash 150 will not be used when there is ample light. The light sensor can optionally be located within the camera 110. Furthermore, the flash 150 can be an ultraviolet or infrared flash so that it is not visible, and in that case the camera would necessarily be capable of viewing an infrared or ultraviolet scene. This would be particularly useful if the stun gun is equipped to automatically capture images between unholstering and discharge, which may well be a period during which the user of the stun gun would not want his or her position revealed by a bright camera flash.

The firing mechanism 105 (i.e. the stun gun trigger) can be configured so that, before it reaches a position causing the projectiles 120 and 125 to fire, but after the user has begun to squeeze the firing mechanism 105, the firing mechanism can send a signal to a central controller 162 (or directly to the camera) causing at least one pre-shock image to be automatically captured by the camera. If the user then releases the trigger without firing, the pre-shock images can be deleted from the storage 155. But, if the user does fire the projectiles, then the camera will have stored pictures immediately preceding and immediately following the firing of the projectiles (possibly in addition to one or more contextual images taken while the gun was unholstered).

When a gun is placed in an authorized holster (i.e. a gun holding device), all images captured since the gun was last holstered may optionally be deleted, if the gun was not fired during that period, except for any images captured using the rear-facing lens 114 unrelated to firing the gun. The camera activation mechanism 145 may be equipped with a holster recognition unit 180, in order to recognize the holster into which the gun is inserted, and thus a user would not be able to delete images by merely pressing on the camera activation mechanism 145. A holster recognition unit 180 can also ensure proper data transfer of at least some data from a stun gun memory unit to a holster memory unit. Alternatively or additionally, failure to insert the stun gun into an authorized holster within a certain time (e.g. 24 hours) can cause the stun gun to automatically become unusable until it is inserted into such a holster (thus a lost, stolen, or misplaced stun gun will automatically shut itself down). A time and date module 177 (such as a clock) can provide the necessary chronological information to the data storage module 155.

Figure 2:
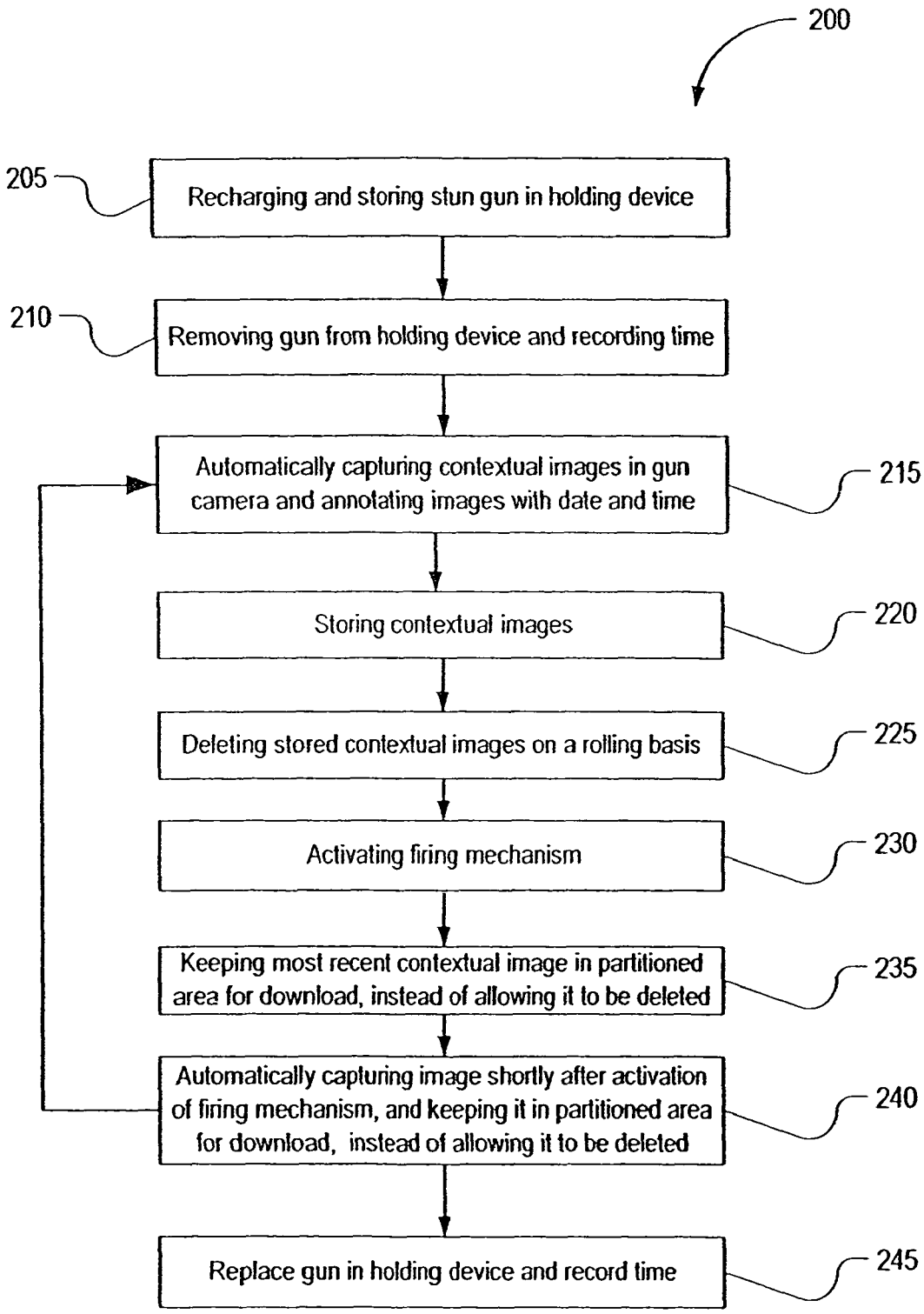
FIG. 2 is a flow chart showing a method of data acquisition according to an embodiment of the present invention, when gun is unholstered.

Turning now to FIG. 2, this shows a method 200 according to the present invention. Initially, the gun is stored in a holding device, where it can optionally be recharged 205 and thereafter be available for use. If the gun is removed 210, the time of removal is recorded automatically. Upon removal of the gun from the holding device, which may be a holster, the gun optionally begins to automatically capture contextual images which are annotated with date and time. These contextual images are images (still, video, and/or audio) taken at other times than immediately after firing the gun, and these contextual images are stored 220. As additional contextual images are taken, some of the previous contextual images can be deleted 225 to create room for the new ones. Then the firing mechanism is activated 230 so that a stun is delivered to a target. The most recent contextual image is then kept 235 instead of allowing it to be deleted, and thus the gun will have a visual (and optionally audio) record of the scene soon before the gun is used to deliver a shock. Then an additional image is automatically captured 240 shortly after activation of the firing mechanism, and this image too is stored. This procedure can be repeated iteratively until the gun is placed back in the holding device 245.

Figure 3:
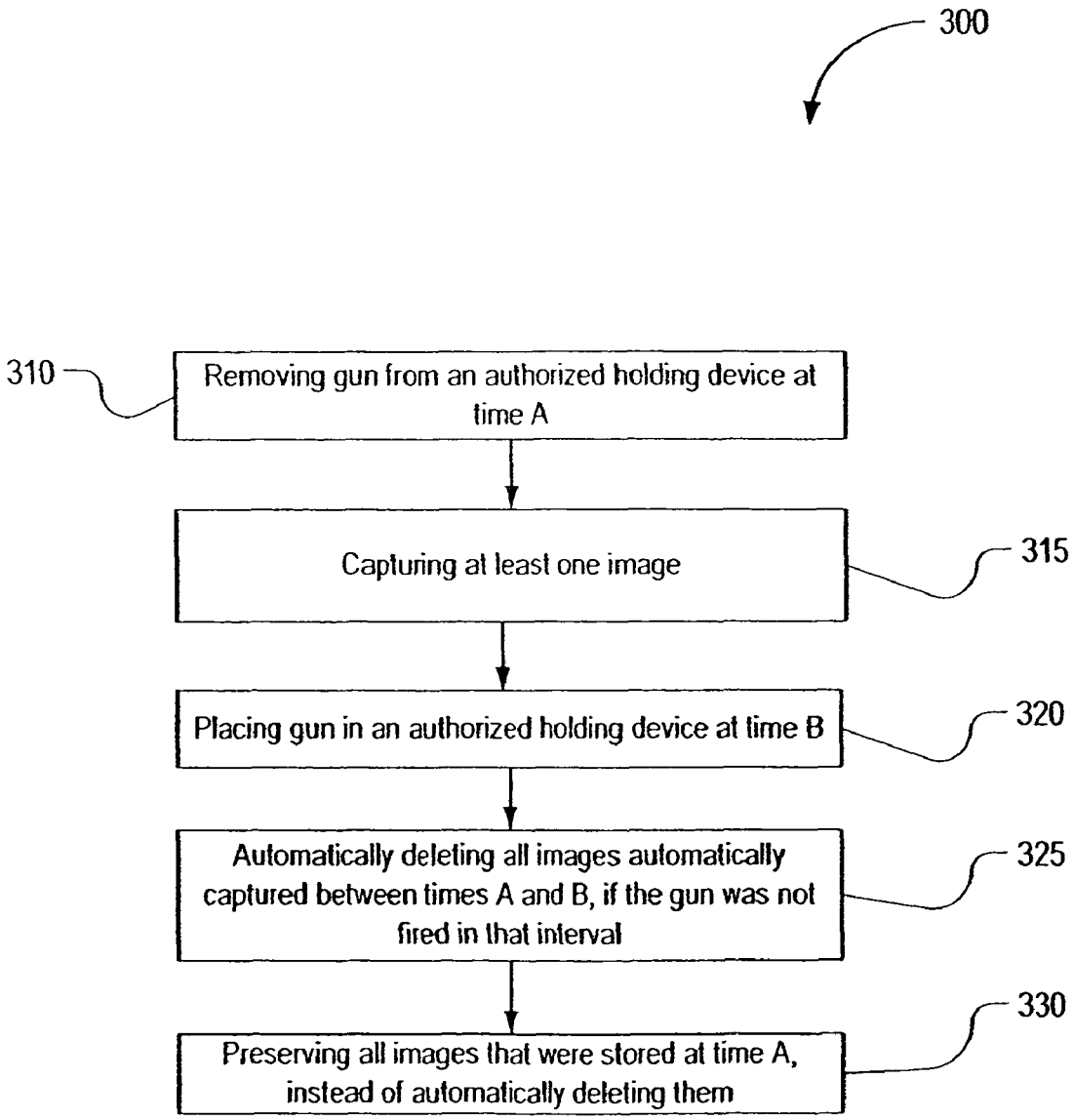
FIG. 3 is a flow chart illustrating deletion of only images collected during an unholstered periods when the gun is not fired.

Referring now to FIG. 3, a method 300 is illustrated for deleting images if the gun has not been fired. First, the gun is removed 310 from an authorized holding device (e.g. a holster that may also provide recharging) at time A. Then images are captured 315, and the gun is inserted 320 into an authorized holding device at time B (this may or may not be the same holding device where the gun was previously located at time A). All images captured between times A and B are then automatically deleted 325 if the gun was not fired during that interval. However, any images that were already stored at time A are preserved 330, instead of automatically deleting them. Those preserved pictures can ultimately be deleted in a police photo laboratory or the like, after they are downloaded and examined.

Figure 4:
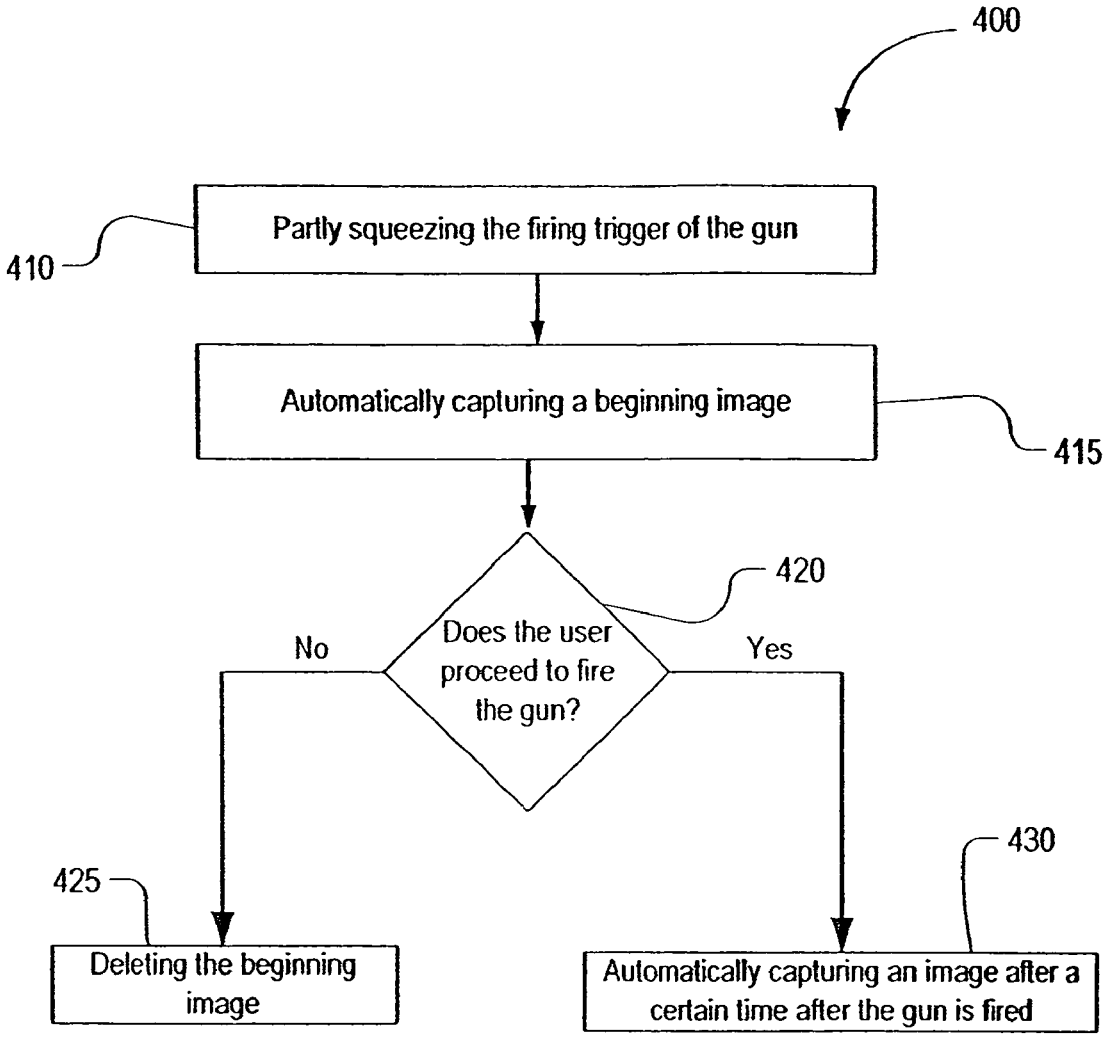
FIG. 4 is a flow chart illustrating how image acquisition is determined by whether a gun is fired.

Referring now to FIG. 4, a method 400 is illustrated for capturing an image immediately before the gun is fired. The user partly squeezes 410 the gun's firing trigger. In response, the camera automatically captures 415 a beginning image. Then the gun senses 420 whether or not the user proceeds to fire the gun. If not, then the beginning picture is deleted 425. However, if the user does proceed to fire the gun (be it a conventional gun, or a stun gun with projectiles, or a stun gun without projectiles), then the camera automatically captures 430 an image within a certain time after the gun is fired.

Figure 5:
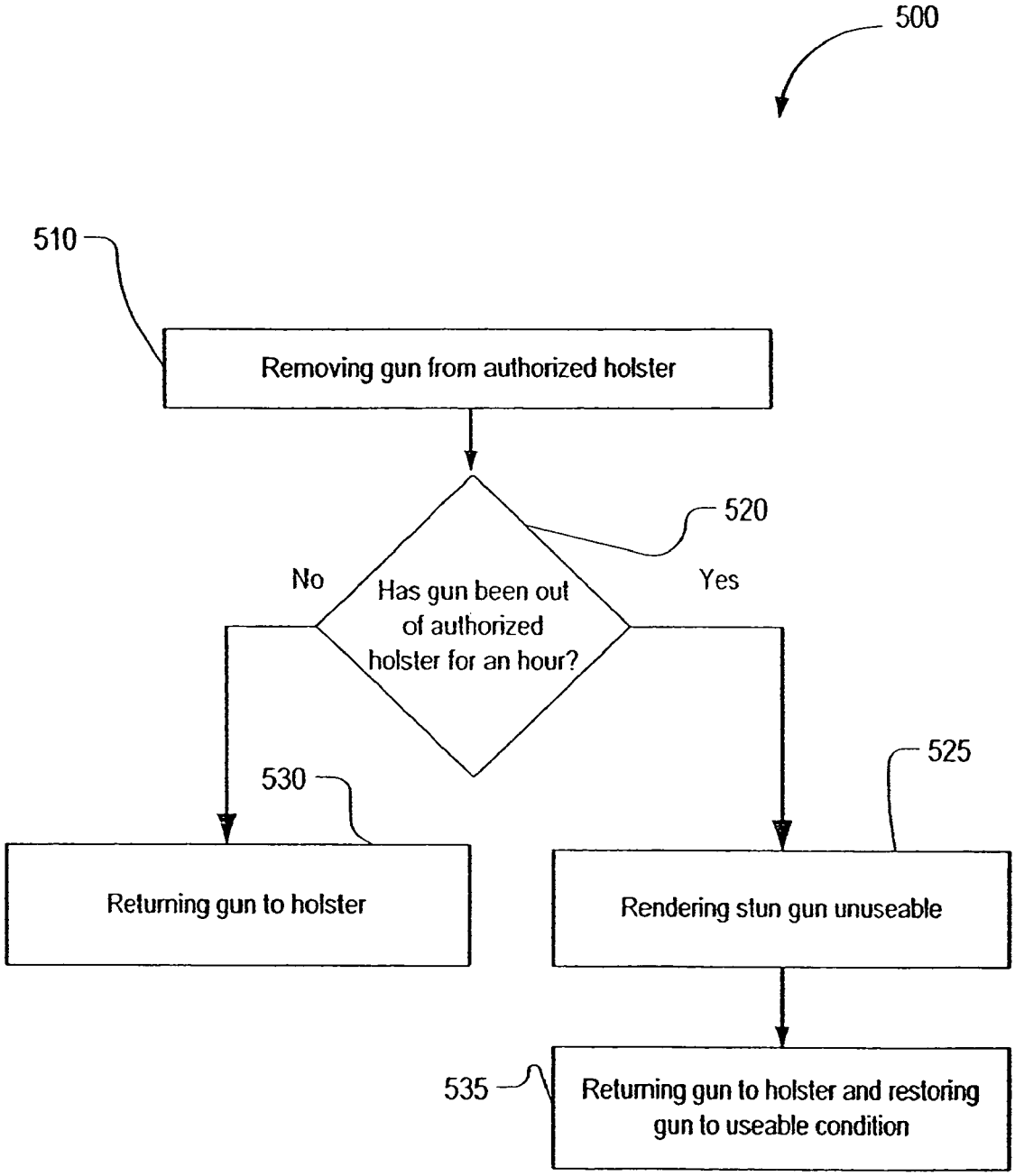
FIG. 5 is a flow chart showing how a timer can be used to eventually render an unholstered gun inoperative.

FIG. 5 shows a method in which the stun gun is removed 510 from its holster, and the stun gun is able to determine whether the gun has been unholstered for more than a particular amount of time (e.g. one hour). After that amount of time, the gun is rendered 525 unusable, and it remains unusable until it is returned 535 to the holster. However, if the gun was not unholstered for more than that particular amount of time, then it remains usable until holstered 530.

In order to more fully explain the invention, the processing of the images will now be illustrated by way of a more detailed example. At time $T_1$, the stun gun is removed from an authorized holster. The gun then acquires contextual images $C_N$ that are separated by, for example, one-second intervals. $C_1$ is captured and stored at 100% image quality. $C_2$ is then captured at 100% quality and the quality of $C_1$ is reduced 10%. $C_3$ is then captured at 100% quality, and the two previous contextual images are reduced a further 10%. In this way, further contextual images are captured, and subsequently reduced in quality. These contextual images are then respectively deleted when quality reaches 25%. It is to be emphasized that, instead of reducing quality of individual images, a percentage of those images could simply be deleted; of course, neither type of technique is necessary if the gun is equipped with sufficient memory capacity to accommodate all desired images (e.g. including both audio and video).

At any time during the acquisition of the contextual images, the user may initiate capture of (for example) at most ten unrelated images $U_N$ which are obtained by pressing a button, and this image comprises a view from the camera's rear lens 114. The $U_N$ are captured at 100% quality, and are not subsequently reduced in quality or deleted.

Then, regardless of whether any $U_N$ have been captured, the user begins to squeeze the firing trigger 105. This causes a beginning image $B_N$ to be captured every tenth of a second. After each $B_N$ is captured, the previously taken $B_N$ are reduced 10% in quality, and are respectively deleted when quality reaches 25%. Capture of the $B_N$ ends when the firing trigger is released, or is fully squeezed so as to fire the gun. If the firing trigger is released instead of being fully squeezed, then all of the $B_N$ are deleted.

Suppose that, at time $T_2>T_1$, the gun is fired. At this point, acquisition of $C_N$ (contextual images) and $B_N$ (beginning images) is terminated. A short time "k" after $T_2$, the camera begins to capture post-firing images $E_N$ thru $E_6$ every half second (for three seconds), and these post-firing images are stored at 100%, 90%, 80%, 70%, 60%, and 50% quality respectively.

At time $T_A=T_2+k$, the whole process begins again, while all of the previously stored images are preserved without deletion or quality reduction, unless storage space runs out (in which case the previously stored $C_N$ can be gradually deleted, e.g. by iteratively deleting every other image). Eventually, the gun is replaced in an authorized gun holding device (i.e. holster) at time $T_B>T_A$. At $T_B$, all stored images captured between $T_A$ and $T_B$ are deleted if the gun was not fired during that interval, except that all unrelated images $U_N$ are preserved. Note that the holster may be a holster installed in a vehicle, and thus may be capable of recharging the gun, and also the holster may be capable of transferring the remaining stored images from the gun to a supplementary storage device, thereby making the gun's full data storage capability fully available again.

Although the invention has been shown and described with respect to best mode embodiments thereof, it should be understood by those skilled in the art that the foregoing and various other changes, omissions and additions in the form and detail thereof may be made therein without departing from the spirit and scope of the invention. It is to be understood that all of the present figures, and the accompanying narrative discussions of best mode embodiments, do not purport to be completely rigorous treatments of the invention under consideration. A person skilled in the art will understand that the various components and structures described herein can be implemented by a variety of different combinations of hardware and software which need not be further detailed herein (e.g. the camera can consist of audio and/or video components that are situated at separate locations on the gun). Likewise, the methods described herein my be implemented in a variety of different sequences with various intervening steps that will be understood by those skilled in the art.

What is claimed is:

1. A system comprising:

a handheld gun equipped with a camera that includes image recording capability; and a gun holding device;

wherein the system further comprises a sensor configured to sense whether the handheld gun is positioned in the gun holding device, wherein the camera is configured to become at least partly activated if the sensor senses that the handheld gun is not positioned in the gun holding device, or is configured to become at least partly activated if a gun safety device has been released, wherein all images captured by the camera are stored in at least one data storage module, and wherein the at least one data storage module is configured to delete a plurality of the images that were captured during an interval when the gun was positioned out of the gun holding device, if the gun was not fired during said interval.

2. The system of claim 1, wherein the sensor is located at the handheld gun or at the gun holding device, or both.

3. The system of claim 1, wherein the handheld gun is a stun gun having a high voltage power supply, and having a battery to provide electrical energy to the high voltage power supply, and wherein the battery provides electrical energy to the camera.

4. The system of claim 3, wherein the camera is further activated when the gun is fired or within a certain time after the gun is fired.

5. The system of claim 1, further comprising:

an image deletion module, for deleting or reducing the quality of at least one previous image after a later image has been stored in the at least one data storage module, wherein the later image precedes firing the gun.

6. The system of claim 5, wherein the data storage module is located at the handheld gun or at the gun holding device, or both.

7. The system of claim 1, wherein the gun holding device also serves as a recharging device.

8. The system of claim 1, wherein the gun holding device comprises a further recording device that is also configured to become at least partly activated when the handheld gun is not positioned in said gun holding device.

9. The system of claim 8, wherein the further recording device is a further camera.

10. The system of claim 1, wherein the gun holding device is a holster.

* * * * *